US007211761B2

(12) United States Patent
Vaghini et al.

(10) Patent No.: US 7,211,761 B2
(45) Date of Patent: May 1, 2007

(54) SWITCH AND DISCONNECTOR APPARATUS FOR ELECTRIC SUBSTATIONS

(75) Inventors: Alberto Vaghini, Piacenza (IT); Armando Rossi, Alatri (IT); Giorgio Perli, Bergamo (IT)

(73) Assignee: Vei Power Distribution S.p.A., Milan (IT)

( * ) Notice: Subject to any disclaimer, the term of this patent is extended or adjusted under 35 U.S.C. 154(b) by 0 days.

(21) Appl. No.: 11/204,368

(22) Filed: Aug. 16, 2005

(65) Prior Publication Data

US 2006/0049144 A1 Mar. 9, 2006

(30) Foreign Application Priority Data

Sep. 7, 2004 (IT) ..... MI2004A1708

(51) Int. Cl.
*H01H 33/14* (2006.01)

(52) U.S. Cl. ..... 218/7; 218/154

(58) Field of Classification Search ..... 218/3, 218/7, 9, 12–14, 67, 71, 78, 80, 84, 120, 218/140, 153, 154
See application file for complete search history.

(56) References Cited

U.S. PATENT DOCUMENTS

| | | | | |
|---|---|---|---|---|
| 3,259,726 | A | 7/1966 | Rueffer | |
| 3,814,883 | A | 6/1974 | Milianowicz | |
| 3,876,849 | A * | 4/1975 | Jackson, Jr. | 200/253.1 |
| 4,105,878 | A | 8/1978 | Date et al. | |
| 4,147,999 | A | 4/1979 | Eley | |
| 4,225,763 | A | 9/1980 | Barkan | |
| 4,659,160 | A * | 4/1987 | Jonval | 439/187 |
| 4,713,503 | A | 12/1987 | Kamp | |
| 6,362,444 | B1 | 3/2002 | Lee | |
| 6,437,276 | B1 | 8/2002 | Bruchmann et al. | |
| 6,649,853 | B2 | 11/2003 | Takagi et al. | |
| 6,683,267 | B1 | 1/2004 | Piazza et al. | |
| 6,696,658 | B2 * | 2/2004 | Kowalyshen et al. | 218/154 |
| 6,723,939 | B2 | 4/2004 | Hoglund et al. | |
| 2005/0150869 | A1 | 7/2005 | Vaghini et al. | |

FOREIGN PATENT DOCUMENTS

BE 788 180 2/1973

(Continued)

OTHER PUBLICATIONS

Standard Search Report for MI20041708 dated May 4, 2005.

*Primary Examiner*—Elvin Enad
*Assistant Examiner*—M. Fishman
(74) *Attorney, Agent, or Firm*—Nixon & Vanderhye P.C.

(57) ABSTRACT

A switch disconnector apparatus of the linear air type is described, said apparatus comprising: an upper device for transferring current, a fixed upper contact connected electrically to the upper device, a lower device for transferring current, a sliding lower contact connected electrically to the lower device and a contact tube movable between a closing position and a disconnecting position. According to the invention, the apparatus also comprises a casing of insulating material which forms a protective atmosphere. Moreover, the contact tube, the upper contact and the lower contact are substantially completely enclosed inside the casing. The disconnector is therefore closed, inside a protected environment, segregated, but not perfectly sealed. With the present invention all the drawbacks associated with unprotected air systems are avoided and a compact and safe apparatus preventing discharges between several phases is provided.

16 Claims, 6 Drawing Sheets

FOREIGN PATENT DOCUMENTS

| | | | |
|---|---|---|---|
| DE | 957 410 | | 1/1957 |
| DE | 1 244 913 | B | 7/1967 |
| DE | 73 16 028 | | 10/1974 |
| EP | 0 737 993 | A1 | 10/1996 |
| EP | 1 226 596 | A0 | 7/2002 |
| FR | 870 991 | | 4/1942 |
| FR | 2 839 193 | A | 10/2003 |
| IT | M195A002592 | | 12/1995 |

* cited by examiner

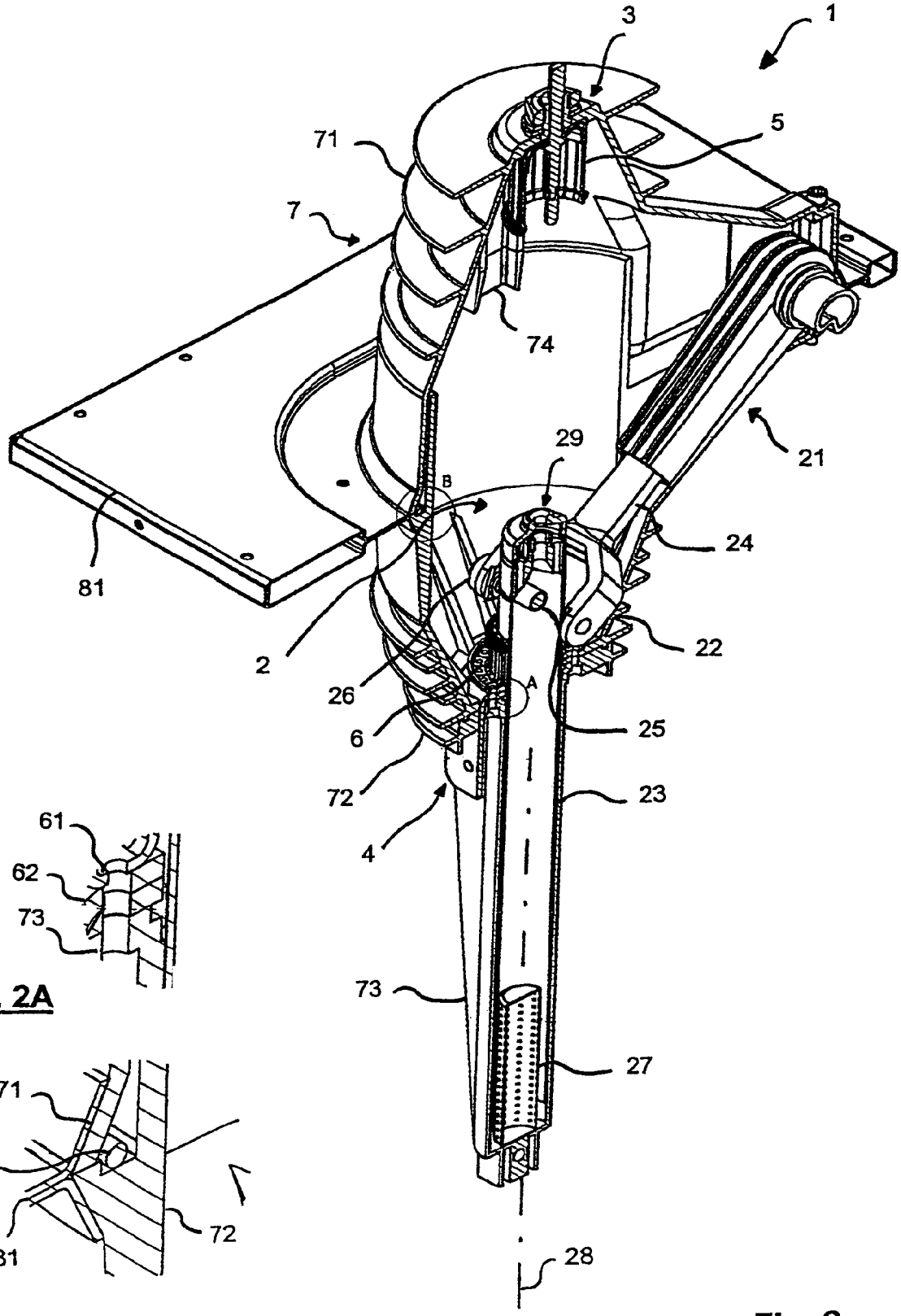
Fig. 2
Fig. 2A
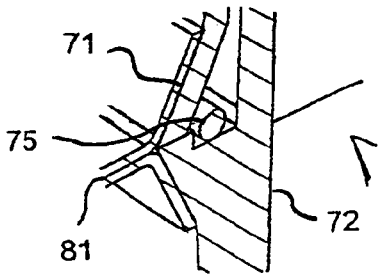
Fig. 2B

SWITCH AND DISCONNECTOR APPARATUS FOR ELECTRIC SUBSTATIONS

This application is based on application No. MI2004A 0001708 filed in Italy, the content of which is incorporated hereinto by reference.

BACKGROUND

1. Field of the Invention

The present invention relates to an electrical apparatus suitable for installation in prefabricated installations inside a metal or insulating casing, which form medium-voltage switchboards. In particular, it relates to an apparatus which, in the closed position, is able to convey in a controlled manner, in keeping within the limits set forth in relevant regulations, the rated current required by the load to which the apparatus is connected and withstand the short-circuit current which may arise as a result of a fault at its terminals. The apparatus according to the invention is able to establish, in its open position, the short-circuit current due to a fault at its terminals. Finally, in the open position, it is able to ensure a disconnecting level suitable for the voltage level of the installation, again in accordance with the regulations.

2. Related Art and Other Considerations

Various apparatuses of the type comprising a switch and a disconnector for electric substations are known. For example, with regard to medium voltage, switch and disconnector apparatuses which perform switching and disconnecting functions in air, gas (for example $SF_6$), oil or a vacuum are known.

Within the category of air switch and disconnector apparatuses, three main types of apparatuses are known, said apparatuses differing from each other on the basis of the type of movement of the movable contacts with respect to the fixed contacts. The first type consists of the rotating type with a central axis of rotation, the second type consists of the linear movement type and the third type consists of the hinge type.

In rotating switch and disconnector apparatuses with a central axis of rotation the movable contacts are in the form of contact blades which extend diametrically from a central axis of rotation about which they are able to rotate. In a first position of rotation, the movable contacts are in contact with the fixed contacts, while in a second position the movable contacts and the fixed contacts are at an isolating distance. In rotating hinge-type switch and disconnector apparatuses, an axis of rotation is formed on the lower contact, about which the movable contact rotates, said contact in a first position being in contact with the upper fixed contact and in a second position being situated at an isolating distance therefrom. In linear switch and disconnector apparatuses there is an upper fixed contact and a lower fixed contact of the sliding type. A conducting tube or bar is moved vertically with a translatory movement, while maintaining the electrical contact between the busbars (or the tube) and the lower contact. The apparatus is able to assume two positions: a first position in which the movable conducting tube or bar is inserted inside the upper fixed contact and a second position in which it is situated at an isolating distance therefrom.

Usually, whatever the type of air switch and disconnector apparatus, an open switching chamber is provided, inside which circuit breaking of the load current is performed by means of a small air jet produced by a piston, the movement of which is guided directly by the displacement of the contact blades of the switch and disconnector apparatus.

The rotating hinge-type switch and disconnector apparatuses are commonly used on overhead supply lines as disconnecting apparatuses and in exposed switchboards (in so-called "raised substations" or "tower substations"). These apparatuses, however, are not suitable for installation in prefabricated installations inside a metal casing (switchboards formed by means of prefabricated cubicles) since in this case segregation between the two terminals, i.e. the upper and lower terminal of the apparatus, is required, at least when the switch and disconnector apparatus is in a open condition, so as to allow access to the cable bay of the cubicle with the live busbars. This latter condition is difficult to achieve in the case of hinge-type switch and disconnector apparatuses. With the advent of prefabricated switchboards and with the introduction of new safety standards, switch and disconnector apparatuses of the rotating type and switch and disconnector apparatuses of the linear type which are more suitable for installation in prefabricated switchboards have been developed.

The purpose of switch and disconnector apparatuses and any device present in a network node is to allow switching and disconnecting of the electric lines which extend from the network node in question. Disconnection is required in particular to allow the operators to be able to carry out maintenance along the whole length of the disconnected line in conditions of maximum safety and with the other lines connected to the network node in question remaining in the live condition. The advent of prefabricated switchboards inside a metal casing has made it possible to achieve the above with a greater degree of safety, namely allow full access to the line which extends from the network node, to which node it is connected via the switch and disconnector apparatus. It is therefore necessary for the operator to be able to access the cubicle connected to the line in question in conditions of maximum safety. When the operator accesses the cubicle, all the parts which are normally live must, in accordance with the regulations, be disconnected and earthed; this is achieved by means of the said switch and disconnector apparatus and an earthing disconnector. This earthing disconnector is interlocked with the door providing access to the cubicle so that it is not possible to open said door if the earthing disconnector is not in the closed position. As mentioned above, moreover, it is necessary to ensure that this line, connected to the cubicle in question, is safely disconnected when the operator accesses the inside of the cubicle. This condition is guaranteed by means of a system mechanically interlocking the switch and disconnector apparatus and the earthing disconnector, the interlocking system preventing closing of the earthing disconnector if the switch and disconnector apparatus is in the closed position, and vice versa. Finally, it is necessary to ensure adequate electrical safety conditions for the operator entering the cubicle, preventing direct contact With the busbars of the switchboard which are still live. For cost-related and dimensional reasons generally the tendency is to use switch and disconnector apparatuses also in order to perform segregation between the busbar bay (inside which the live busbars are present) and the line cell (accessed by the operator). According to Italian patent application MI95A002592, this segregation is performed by means of a metal gate which is arranged between the fixed contacts and the movable contacts of the switch and disconnector apparatus when the latter is isolated. The displacement of the metal gate is associated with the movement of the earthing disconnector, in particular closing of the earthing disconnector also closes simultaneously the metal gate so that, when the operator opens the door of the cubicle for access thereto, in addition to a guarantee that the normally live parts are earthed (by means of the gate), there is also the guarantee of segregation from the bay containing the busbars which are still live. The presence of the shutter gate is therefore of fundamental importance when the substation is open and personnel have access thereto.

The presence of the shutter gate ensures that the apparatus complies with the safety conditions according to the regulations. Nevertheless, the Applicants have established that there is need to provide an even greater degree of protection.

Based on the fact that all additional devices for performing a function may intrinsically be the cause of a malfunction, the Applicant has set itself the aim of producing a similar segregating function without any additional mechanical device (such as the metal gate and its actuating arrangement in the known apparatus according to Italian patent application MI95A002592).

In addition to this, it is known that the switching (circuit breaking) performance of all the air switch and disconnector apparatuses is greatly dependent upon the environmental conditions, in particular the humidity of the air and the presence of polluting substances or salinity (in environments close to the sea). For example, in environments which are polluted or have a severe climate there is a deterioration of the conductive materials, in particular the parts making sliding contact, until, with time, seizing of said parts occurs.

It must be remembered that the switch and disconnector apparatuses, in most applications, may be subject to periods during which a high number of operations is required and periods of inactivity, but the fundamental condition is that when these apparatuses are required to operate they must do so in an absolutely safe and reliable manner. This is possible only if the contacts of the apparatus are kept in working order and clean. However, in the case of installations in humid and/or polluting climates, this is not possible with the known linear air switch and disconnector apparatuses unless they are subject to frequent programmed maintenance. On the other hand, the present tendency, primarily for cost-related reasons, is that of keeping the maintenance carried out on apparatus to a minimum. It is therefore clear that there exists the need to provide an apparatus which is segregated as far as possible from the external environment and therefore not affected by the conditions prevailing therein.

Another drawback precisely of linear air switch and disconnector apparatuses is that they must be mounted on a particularly strong metal structure which is able to withstand, without deformation, considerable forces so as to operate the arm which moves axially the bar or tube of conductive material.

Frequently the switch and disconnector apparatuses are mounted in sets of two or three so as to obtain, respectively, two-phase or three-phase apparatuses. With regard to two-phase or three-phase linear air switch and disconnector apparatuses, there is no segregation of the various phases. Therefore, in known switch and disconnector apparatuses there is the risk that an arc may occur between phases and that an (otherwise harmless) "non interruption" may result in a two-phase or three-phase short-circuit. The only precaution which is adopted in double-pole or triple-pole linear air switch and disconnector apparatuses is that of arranging an individual switch and disconnector apparatus at a suitable distance from the next one. This does not eliminate entirely the abovementioned problems and in any case results in the apparatus being excessively voluminous.

FR 870 991 A discloses an electric switch suitable for being used in environments exposed to explosive gas.

DE 957 410 C discloses a single-pole off-load switch.

DE 73 16 028 U discloses an insulate-totally enclosed high voltage switching station.

BE 788 180 A1 discloses a supply disconnection element for an electric apparatus.

U.S. Pat. No. 3,259,726 A discloses a telescoping type circuit breaker having isolator contact with arc snuffing means.

U.S. Pat. No. 3,814,883 A discloses a gas-blast circuit interrupter with insulating arc shield.

In the light of the problems and the limitations of known switch and disconnector apparatuses, the Applicant has established that there is a need to provide an improved linear air switch and disconnector apparatus which is able to solve said problems and overcome said limitations.

Therefore, the main object of the present invention is to provide a linear air switch and disconnector apparatus which is safe and reliable and in which the circuit breaking/switching performance is not substantially dependent upon the environmental conditions (within a protected atmosphere).

A further object of the present invention is to provide a linear air switch and disconnector apparatus which is more compact than the existing similar apparatuses, does not require a particularly strong support structure and is sufficiently low-cost.

A further object of the present invention is to provide a linear air switch and disconnector apparatus having each phase segregated so that there is absolutely no risk of a "non-interruption" of the apparatus resulting in a two-phase or three-phase short-circuit.

These and other objects are achieved by means of a linear air switch and disconnector apparatus having the characteristic features of the independent claim 1. Further advantageous features of the present invention are contained in the dependent claims. All the claims are considered to form an integral part of the present description.

BRIEF SUMMARY

According to the present invention a switch and disconnector apparatus of the linear air type is provided, said apparatus comprising: an upper device for transferring current, a fixed upper contact connected electrically to said upper device, a lower device for transferring current, a sliding lower contact connected electrically to said lower device, a contact tube movable between a closing position and an disconnecting position and a casing of insulating material which forms a protective atmosphere within it. The contact tube, the upper contact and the lower contact are substantially completely enclosed inside the casing. According to the invention the apparatus also comprises a telescopic connecting rod which is pivotable by an actuating shaft and which has a connecting-rod plunger, wherein said contact tube is constrained to said telescopic connecting rod and thus is movable between said closing position and said disconnecting position.

The casing, conveniently, comprises an upper bell, a lower bell and a lower-pole guide body which extends from the lower bell.

Profitably, a metal ring for draining superficial earthed currents is housed between the upper bell and the lower bell.

Conveniently, the casing is made of polyester, epoxy resin or the like.

Preferably, the connecting-rod plunger has one end in the form of a fork made of insulating material. The contact tube is constrained to the telescopic connecting rod by means of said fork-shaped end and a pin which passes through the contact tube.

Conveniently, also the telescopic connecting rod is contained inside the insulating casing. As said above, the telescopic connecting rod is rotatable by means of at least one actuating shaft, the rotation of the actuating shaft causes a translation of the contact tube substantially without transmitting radial forces to it.

Preferably, the axis of rotation of the telescopic connecting rod lies in a plane perpendicular to the axis of the contact tube which intersects the axis of the contact tube at a point between the upper contact and the lower contact.

Conveniently; guide rollers and corresponding translation guides for guiding the translatory movement of the contact tube are provided.

Typically, the guide body is substantially tubular with a closed bottom end and comprises a seal between the outer surface of the tube and the inner surface of the guide body so as to produce an air jet and extinguish an arc between an upper arc-breaking contact and a lower arc-breaking contact.

Typically, the lower contact is tulip-shaped and comprises contact strips kept elastically in sliding contact with the tube, said contact strips being fixed to a connection Which conveys the current outside of the casing.

Typically the upper contact is tulip-shaped and comprises contact strips, an upper spring and a through-stem having an end made of sintered material which acts as an upper arc-breaker.

Conveniently, the sintered material comprises copper and tungsten.

Preferably, inside the guide body there is a perforated cylindrical container for purifying and dehumidifying the air contained inside the guide body.

According to the present invention, two, three or more switch and disconnector apparatuses as described above are associated so as to form a two-phase, three-phase or multiphase apparatus. In this case, the telescopic connecting rod of each individual switch and disconnector apparatuses is rotatable about a same axis of rotation.

BRIEF DESCRIPTION OF THE DRAWINGS

The present invention will become clear from the detailed description which follows, to be read with reference to the accompanying plates of illustrative drawings in which:

FIG. 2 shows an axohometric cross-section through a linear air switch and disconnector apparatus according to the invention in an isolating configuration;

FIG. 2A shows the detail A of FIG. 2;

FIG. 2B shows the detail B of FIG. 2;

DETAILED DESCRIPTION

Figure 1:
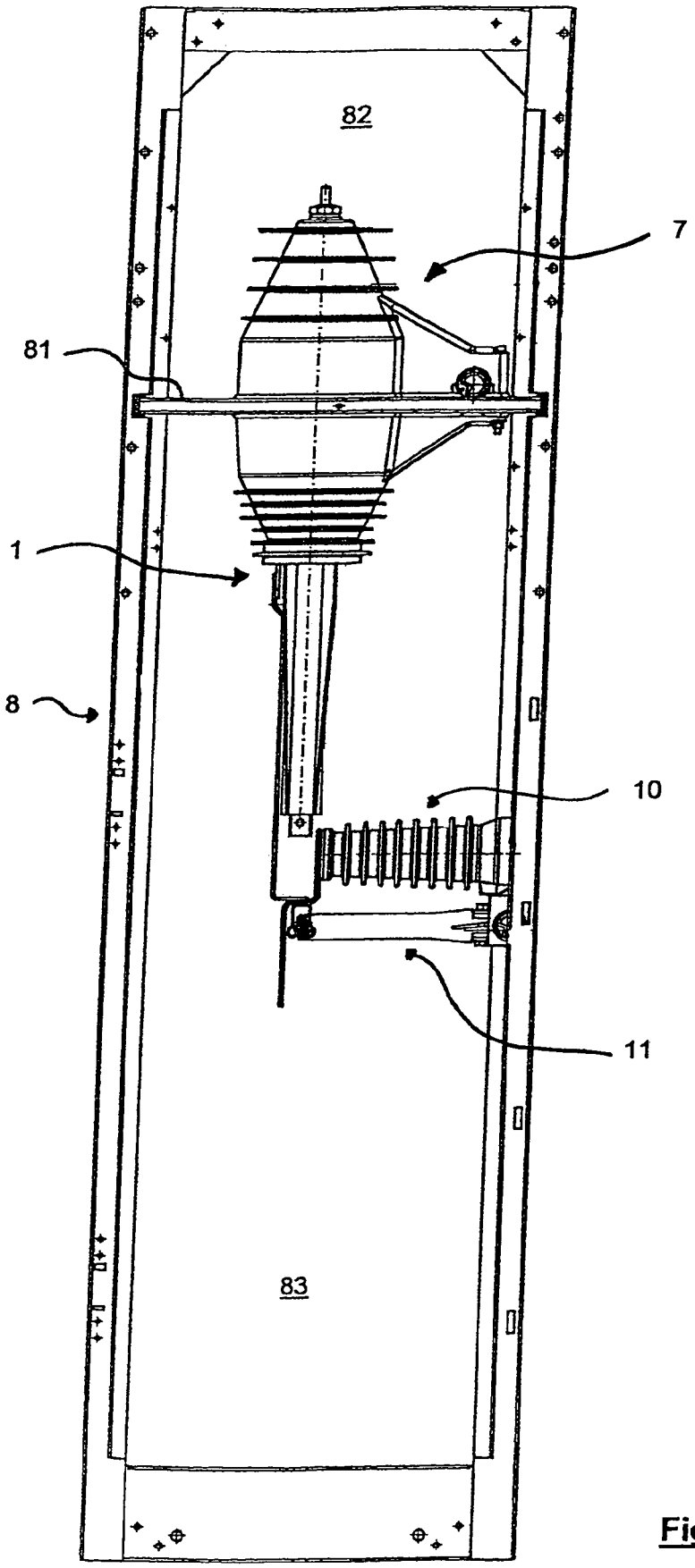
FIG. 1 shows a linear air switch and disconnector apparatus according to the invention in a cubicle for electricity substations.
Figure 4:
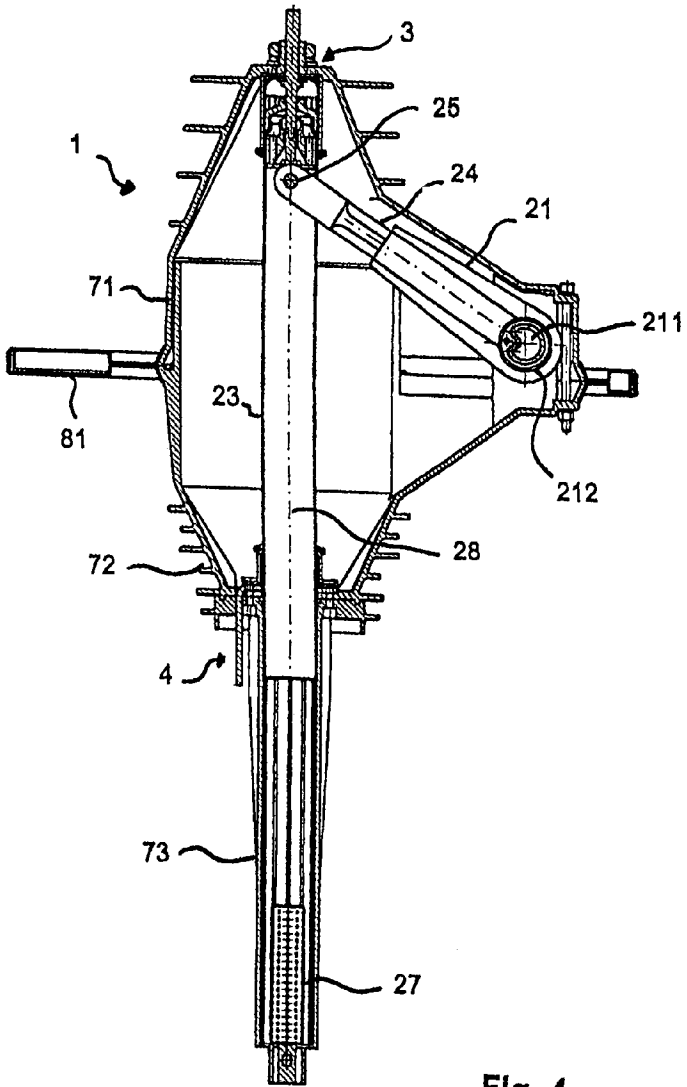
FIG. 4 shows a flat cross-section through a linear air switch and disconnector apparatus according to the invention in a closing configuration.
Figure 3:
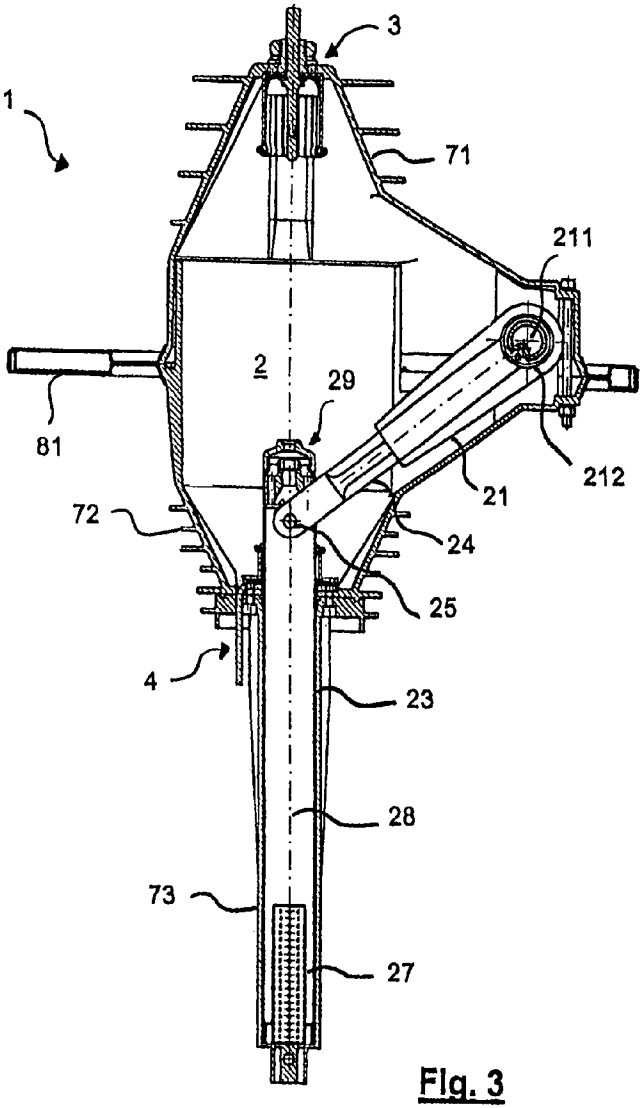
FIG. 3 shows a flat cross-section through a linear air switch and disconnector apparatus according to the invention in a disconnecting configuration.

With reference to FIGS. 1–4, the linear air switch and disconnector apparatus according to the invention is indicated overall by the reference number 1. Two, three or more switch and disconnector apparatuses 1 may be associated together so as to obtain a switch and disconnector apparatus which is two-phase, three-phase, etc. FIG. 1 shows the switch and disconnector apparatus 1 according to the invention inside a cubicle 8 supported by a base 81. FIG. 1 also shows a capacitive insulator 10 and an earthing disconnector 11. The capacitive insulator 10 is an insulator which, in addition to the usual function of keeping supported and isolated busbars which are normally live, also has the function of detecting the voltage. This function is performed by means of a capacitive coupling (a capacitor) situated inside the said insulator which enables a signal to be obtained or otherwise, depending on whether or not there is voltage on the busbar.

The earthing disconnector 11 is a safety device, the purpose of which is to earth the electrical circuits which are normally live before making them accessible to personnel; this is simply performed by means of simple contact blades which are connected to earth and operated outside the casing of the switchboard: a person, before being able to access the switchboard, is obliged to connect these blades to the parts which are normally live (for example by means of pincers). In this way it is certain that the normally live parts are earthed.

The switch and disconnector apparatus 1 comprises a line disconnector 2 (or also simply "disconnector"), an upper device 3 for transferring the current, connected to a fixed upper contact 5, a lower device 5 for transferring the current, connected to a sliding contact 6 and a casing 7 made of insulating material.

The line disconnector 2 comprises a translatable telescopic connecting rod 21 which is pivotably mounted about an axis 211 of an actuating shaft 212. The translatable connecting rod 21 has a connecting-rod plunger 24 which terminates in a fork 22 for engagement with a movable contact tube 23 made of electrically conductive material, for example copper. In the embodiment shown, the connecting rod 21 engages with the electrically conductive tube 23 by means of a pin 25 which passes transversely through the tube 23 from one arm to the other of the fork 22.

The fork-shaped end 22 of the telescopic connecting rod 21 also comprises guide rollers 26 sliding inside a guide 74 (to be described below) such that the electrically conductive tube 23 is guided with a perfectly translatory movement.

Conveniently, the electrically conductive tube 23 is internally hollow. The top part thereof, which comes into contact with the upper contact when the circuit is closed, is suitably shaped, forming a blowing nozzle 29: in this way a jet of air is created and directed between the fixed contact 5 and the tube 23 when these are separated. As will be described below, the jet of air is created owing to a plunger effect between the conducting tube 23 and an insulating guide body 73 situated around it and separated from the tube 23 by a seal. The nozzle is, conveniently, made of a sintered material, preferably copper/tungsten. As shown in the cross-section according to FIG. 6 and in particular of FIG. 2A, the blower nozzle 29 comprises an arc-breaker support 291 and a lower arc-breaker contact 292.

According to the present invention, the line disconnector 2 of the switch and disconnector apparatus 1 is closed inside an insulating casing 7. The expression "closed inside an insulating casing", for the purposes of the present invention, is understood as meaning that the contacts 5, 6 of the isolator 2 are separated from the external environment thanks to a casing 7 made of insulating material, but that the interior is not perfectly sealed with respect to the exterior. During use, i.e. when the casing 7 is closed, the inside of the casing 7 will contain air (and not another gas) and will not be subject to a vacuum. In other words, the casing 7 forms a protective atmosphere, i.e. an environment which is "protected", "segregated", but not completely sealed as it should be in similar gas or vacuum switch and disconnector apparatuses.

The casing 7 consisting of insulating material may, for example, be made of epoxy resin but, preferably, polyester which has a cost less than that of epoxy resin and is able to be pressed more easily. Alternatively, it may also be made of any insulating material with suitable mechanical and electrical properties. The casing 7 comprises conveniently an upper bell 71, a lower bell 72 and a guide body 73 of the tube 23. It is worth pointing out that any reference to relative positions made in the present description and in the claims, such as for example "upper" and "lower", is solely for the purpose of simplifying the description, but must not be understood in a limiting sense. In fact, a switch and disconnector apparatus may also be inclined, horizontal or inverted with respect to the position shown in the various figures.

The upper bell 71 of the casing 7 is partially finned and terminates in an upper opening from which the upper device 3 for transfer of the current projects. The lower bell 72 of the casing 7, which is also partially finned, is preferably joined by means of interlocking with the upper bell 71 and, by means of threaded members, to the guide body 73. The bells 71 and 72 are suitably shaped so as to house the disconnector 2, and the lower body 73 is substantially internally tubular.

Two substantially C-shaped guides 74, able to be engaged by the guide rollers 26 of the translatable connecting rod 21, are formed integrally pressed inside the upper bell 71. The guide 74 has preferably a shaped mouth so as to form a receiving surface. A discharge draining ring 75 is provided between the upper bell 71 and the lower bell 72, said ring preventing a superficial current from passing from the upper bell to the lower bell. Basically, the ring 75 drains any superficial currents.

The guide body 73 of the insulating casing 7 is substantially in the form of a cylindrical tube closed at the bottom and connected to the lower bell 72 by means of screws or the like. As mentioned above, a seal is arranged between the guide body 73 and the conducting tube 23 so that the conducting tube 23 behaves substantially in the manner of a piston plunger. At the base of the conducting tube 23 there is a cylindrical container 27, for instance of a type for molecular sieves. The container 27 is perforated and allows the circulation of air for the purpose of purifying and dehumidifying the air contained inside the guide body 73.

Figure 5:
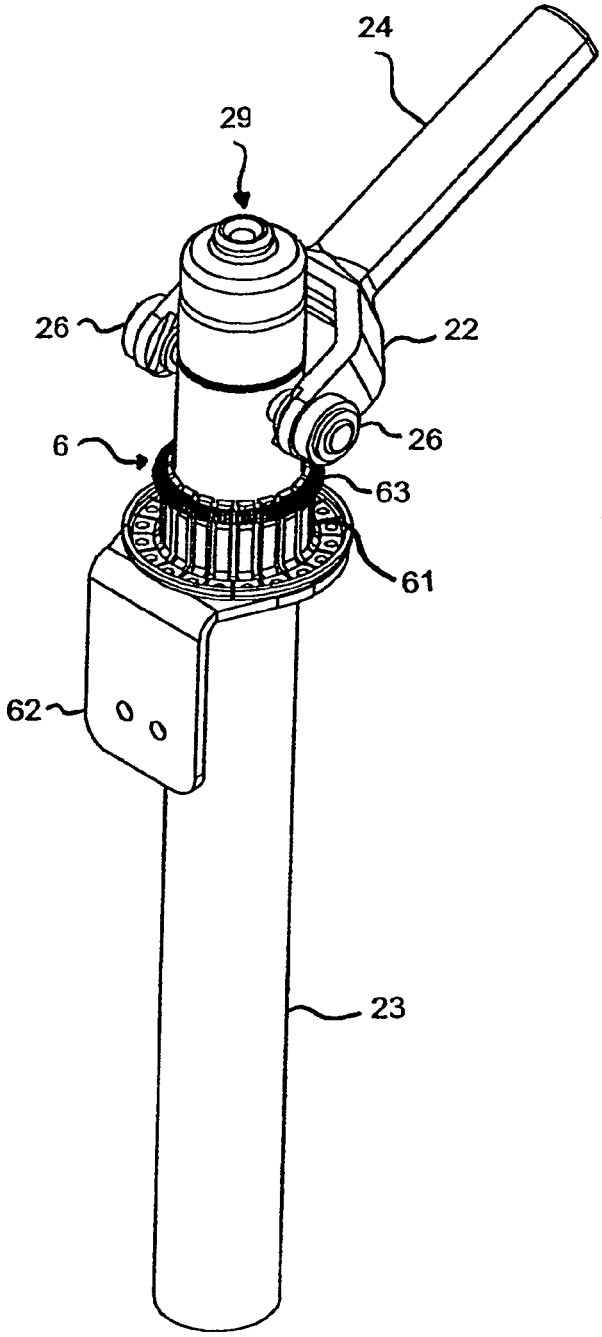
FIG. 5 shows an axonometric view of the conducting tube and the lower contacts of the switch and disconnector apparatus according to the invention.
Figure 6:
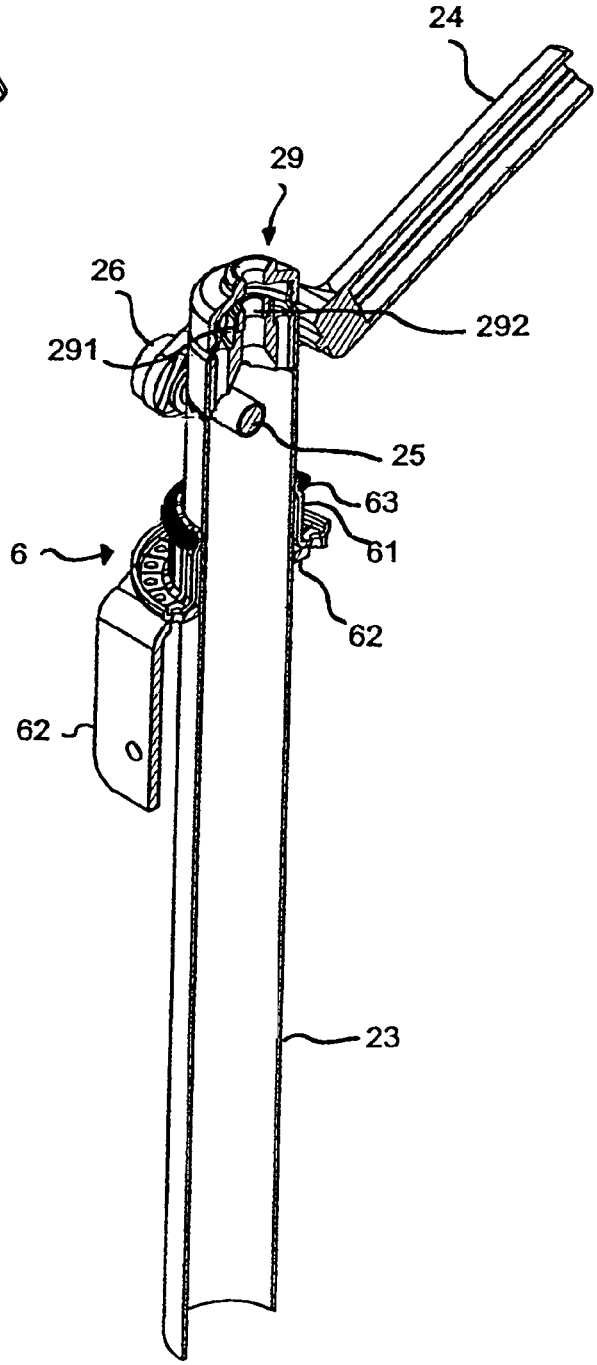
FIG. 6 shows an axonometric cross-sectional view of the conducting tube and the lower contacts of the switch and disconnector apparatus according to the invention.

The lower sliding contact 6 is shown more clearly in FIGS. 5 and 6. The "tulip-shaped" sliding contact 6 is formed by means of a plurality of petals 61 made of conductive material (for example copper) riveted circumferentially onto a plate 62 of conductive material (for example copper) which is suitably shaped and able to convey the current outside the casing (i.e. outside the protected zone). The plate 62 forms the lower terminal lug. The same petals 61 touch along their top end the movable contact tube 23 and are held in position there by means of a spring 63.

Figure 9:
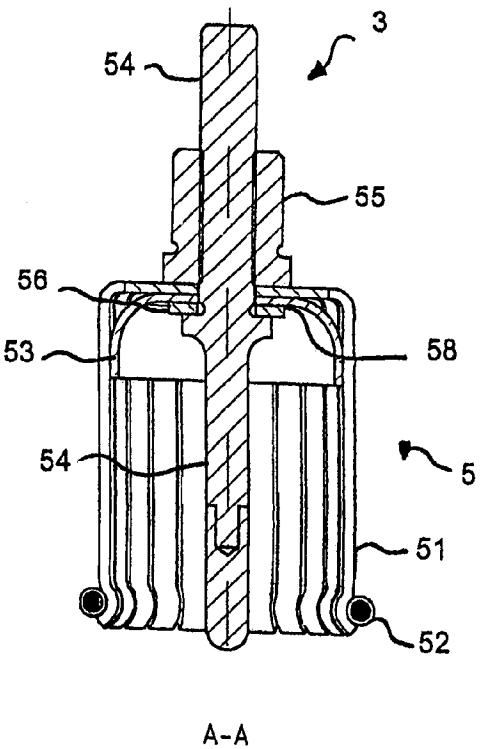
FIGS. 7, 8 and 9 are, respectively, an axonometric view, a side view and a cross-sectioned view of the upper fixed contact of the apparatus.
Figure 8:
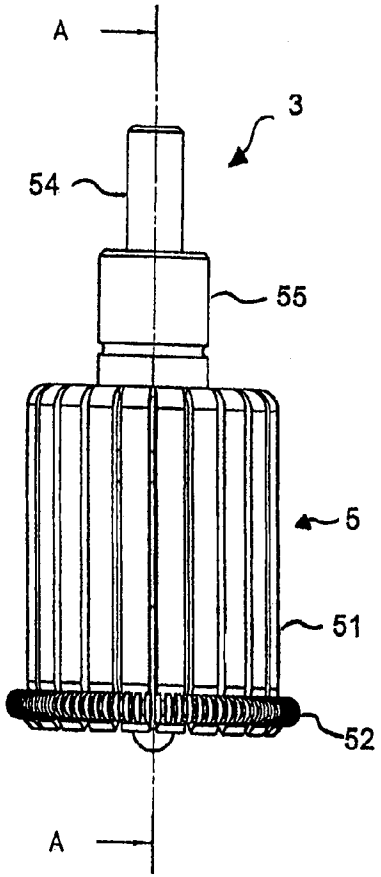
Figure 7:
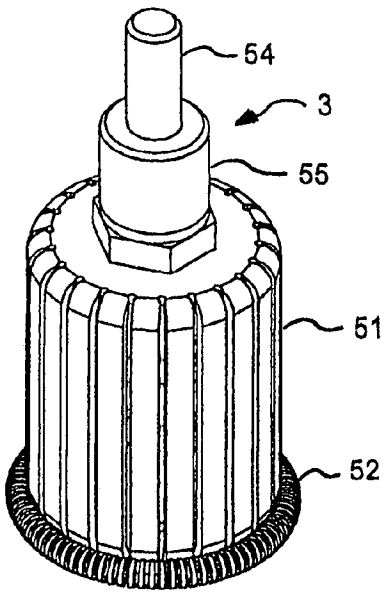

The assembly consisting of upper terminal lug 3 and fixed upper contact 5 is clearly shown in FIGS. 7, 8 and 9. It comprises a tulip-shaped contact with petals 51 directed downwards, a spring 52 for compressing the petals 51 and ensuring a good electrical contact with the conducting tube, a support bowl 53 (for example made of steel), a stem 54, a contact bush 55 and contact washer 56. The stem has a bottom part which extends in the manner of a stalk (and hence downwards) and a threaded top shank part which extends outside it. Between the two top and bottom parts there is a shoulder 58 with, resting thereon, the washer 56 and the bowl 53 which prevent the tulip-shaped contact from being deformed. The bush 55 is screwed (or in any case fixed) onto the stem part projecting from the top. The top end of the bush 55 ensures electrical continuity between the tulip-shaped contact and the voltage busbars (not shown) which are fixed to the top end of the stem 54 made of steel. Conveniently, the bottom end of the stem 54 is made of sintered material, typically copper/tungsten, which withstands well the electric arc and does not allow erosion of the contacts. For the same reason, the nozzle 29 of the conducting tube is made of sintered material.

As mentioned above, two or three switch and disconnector apparatuses are generally connected together so as to provide a two-phase or three-phase switch and disconnector apparatus. In this case, the movement of the respective telescopic connecting rods 21 is synchronized and is performed by means of a single control shaft 212 connected to an actuating device, for example a spring device.

Figure 10:
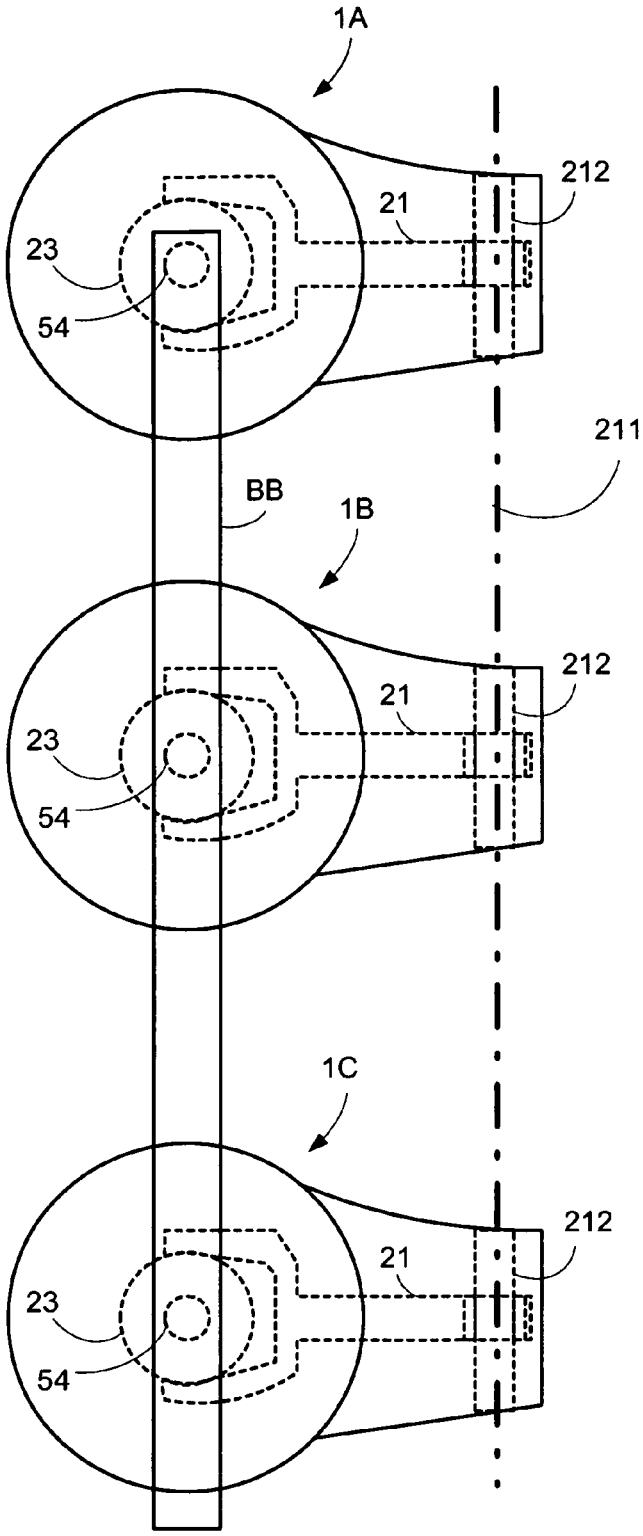
FIG. 10 is a top diagrammatic view showing a switch disconnector apparatus of the linear air, two-phase or three-phase type, having the through-stems of two or more (for example, three) disconnector apparatus connected by a bus bar BB.

In the above regard, FIG. 10 is a top diagrammatic view showing a switch disconnector apparatus of the linear air, two-phase or three-phase type, having two or more (for example, three) disconnector apparatus 1A, 1B, and 1C. The through-stems 54 of the respective disconnector apparatus 1A, 1B, and 1C are connected by a bus bar BB which serves to couple the disconnector apparatus 1A, 1B, and 1C. In the example arrangement shown in FIG. 10, the telescopic connecting rod 21 of each individual switch disconnector apparatus is rotatable about a same axis of rotation, e.g., the axis 211 also shown in FIG. 3 and FIG. 4.

The axis of rotation 211 about which the telescopic connecting rod(s) 21 rotate(s) lies in a plane perpendicular to the axis ~ 28 of the apparatus. This plane of the axis 211, in the disconnecting configuration, intersects the axis 28 of the apparatus at a point above the top end of the conducting tube 23. On the other hand, in the closed circuit position, the intersection between the plane of the axis ~ 211 of rotation of the telescopic connecting rods 21 and the axis 28 of the apparatus is below the top end of the conducting tube 23. In other words the connecting rods 21 rotate about an axis 211 lying in a plane perpendicular to the axis 28 of the apparatus and situated between the fixed contact 5 and the sliding contact 6. In this way, the frame supporting the apparatus may be less rigid than that of the known apparatuses where there was an arm of considerable length which produced a high moment on the structure. With the present solution, the twisting forces are cancelled out along the same axis 211 of the actuating shaft 212.

Conveniently, the single switch and disconnector apparatus 1 or the two/three switch and disconnector apparatuses 1 are fixed to the base 81 inserted inside a cubicle 8 for electric substations. The support plate 81 separates an upper cubicle part 82 where the voltage busbars run from a lower cubicle part 83 where the power lines run. Owing to this solution according to the present invention, there is no danger of an operator touching the voltage busbars or parts connected thereto, upon entering the substation once the switch disconnector apparatus is in the disconnected state.

Compared to the known solutions, in particular that in accordance with Italian patent application MI95A002592 where the walls of the cubicle were an integral part of the switch disconnector apparatus, the switch and disconnector apparatus 1 according to the present invention is constructed as a stand-alone component and is simply inserted into the cubicle 8. The fact that the various switch and disconnector apparatuses 1 of a two-phase or three-phase switch disconnector apparatus are closed by an insulating casing 7 means that it is possible to have two or more switch and disconnector apparatuses close to each other and make the two-phase or three-phase switch disconnector apparatus particularly compact. For the same reasons, the risk of discharges between phases is substantially prevented.

The mode of operation of the switch and disconnector apparatus 1 according to the invention is as follows. Starting from the configuration where the installation is closed (FIG. 4) an opening command is given, rotating the actuating shaft 212 in the anti-clockwise direction. The translatable connecting rod 21 pulls the conducting tube 23 downwards. The conducting tube 23 moves away from the upper fixed contact 5 and the current is then switched onto the arc contacts (54 and 29). In this way the electric arc, owing to the shape of the stem 54 and the nozzle 29, is forced to form precisely at the ends of the stem and the nozzle when the latter also separate. This is the reason why they are made of a material with a high resistance to the electric arc. In the meantime, the speed of translatory movement of the tube 23 compresses the air inside the guide body 73 of the casing 7 and forces it to leave the nozzle 231, extinguishing the arc. The movement of the tube 23 is guided by the guide rollers 26 inside the guide 74. Any superficial currents created inside the upper bell 71 are drained to earth by means of the draining ring 75 and are not transferred to the lower bell 72 of the casing 7 or to the sliding contact 6.

The fact that, inside the casing 7, there is air in a protective atmosphere is undoubtedly advantageous from the point of view of the environmental impact and economy of the switch and disconnector apparatus: in fact the construction of a fluid-tight casing is not required and the pressure of the gas inside the casing does not have to be controlled. In any case, all the drawbacks associated with unprotected air systems are avoided.

The switch and disconnector apparatuses according to the present invention may be used for the operation of transformers (with load or loadless), cables and overhead lines uncharged or charged, series of capacitors, loop circuits, etc. Although the switch and disconnector apparatus according to the invention has been illustrated solely in a substantially vertical position, it may also be installed in an inclined or horizontal position and mounted on a wall, on a frame, inside a substation, inside a bay or inside prefabricated switchboards.

The invention claimed is:

1. A switch and disconnector apparatus of the linear air type comprising: an upper device for transferring current, a fixed upper contact connected electrically to said upper device, a lower device for transferring current, a sliding lower contact connected electrically to said lower device and a contact tube movable between a closing position and an disconnecting position, a casing of insulating material which forms a protective atmosphere within it, wherein said contact tube, said upper contact and said lower contact are substantially enclosed inside said casing, characterized in that the apparatus also comprises a telescopic connecting rod which is pivotable by an actuating shaft and which has a connecting-rod plunger, wherein said contact tube is constrained to said telescopic connecting rod and thus is movable between said closing position and said disconnecting position.

2. The apparatus according to claim 1, wherein the casing comprises an upper bell, a lower bell and a lower-pole guide body which extends from said lower bell.

3. The apparatus according to claim 2, wherein a metal ring for draining superficial earthed currents is housed between the upper bell and the lower bell.

4. The apparatus according to claim 1, wherein said casing is made of polyester, epoxy resin or the like.

5. The apparatus according to claim 1, wherein said connecting-rod plunger has one end in the form of a fork made of insulating material, wherein said contact tube is constrained to said telescopic connecting rod by means of said fork-shaped end and a pin which passes through said contact tube.

6. The apparatus according to claim 5, wherein said telescopic connecting rod is contained inside the insulating casing.

7. The apparatus according to claim 5, wherein the rotation of the actuating shaft causes a translatory movement of the contact tube substantially without transmitting radial forces to it.

8. The apparatus according to claim 5, wherein the axis of rotation of the telescopic connecting rod lies in a plane perpendicular to the axis of the contact tube which intersects said axis at a point between the upper contact and the lower contact.

9. The apparatus according to claim 5, further comprising guide rollers and corresponding translation guides for guiding the translatory movement of said contact tube.

10. The apparatus according to claim 1, wherein said guide body is substantially tubular with a closed bottom end and comprises a seal between the outer surface of the tube and the inner surface of the guide body so as to produce an air jet and extinguish an arc between an upper arc-breaking contact and a lower arc-breaking contact.

11. The apparatus according to claim 1, wherein the lower contact is tulip-shaped and comprises contact strips kept elastically in sliding contact with the tube, said contact strips being fixed to a connection which conveys the current outside of the casing.

12. The apparatus according to claim 1, wherein said upper contact is tulip-shaped and comprises contact strips, an upper spring and a through-stem having an end made of sintered material which acts as an upper arc-breaker.

13. The apparatus according to claim 12, wherein the sintered material comprises copper and tungsten.

14. The apparatus according to claim 10, further comprising, inside said guide body, a perforated cylindrical container for purifying and dehumidifying the air contained inside the guide body.

15. A switch disconnector apparatus of the linear air, two-phase or three-phase type, comprising, respectively, two or three apparatuses according to any one of the preceding claims coupled by means of a busbar connected to a through-stem.

16. The apparatus according to claim 15, wherein the telescopic connecting rod of each individual switch disconnector apparatus is rotatable about a same axis of rotation.

* * * * *